US005857786A

United States Patent [19]

Randolph

[11] Patent Number: 5,857,786

[45] Date of Patent: Jan. 12, 1999

[54] MODULAR PRINTER SYSTEM WITH DEPLETING RIBBON SUPPLY ROLL AND HEATED TYPEHOLDER

[75] Inventor: Craig R. Randolph, Joliet, Ill.

[73] Assignee: Illinois Tool Works Inc., Glenview, Ill.

[21] Appl. No.: 934,718

[22] Filed: Sep. 22, 1997

[51] Int. Cl.[6] ..... B41J 33/14

[52] U.S. Cl. ..... 400/234; 400/207

[58] Field of Search ..... 400/234, 207, 400/208, 120.01, 120.08

[56] References Cited

U.S. PATENT DOCUMENTS

| | | | |
|---|---|---|---|
| 3,961,575 | 6/1976 | Rodabaugh | 101/9 |
| 4,334,471 | 6/1982 | Noyes et al. | 101/228 |
| 4,350,454 | 9/1982 | Schoenlein | 400/234 |
| 4,453,468 | 6/1984 | Shenoba | 101/382 |
| 4,559,872 | 12/1985 | Perra, Jr. | 101/228 |
| 4,627,342 | 12/1986 | Yui | 101/25 |
| 5,284,396 | 2/1994 | Masumura et al. | 400/234 |
| 5,306,097 | 4/1994 | Kaneko | 400/120 |
| 5,433,539 | 7/1995 | German | 400/225 |
| 5,450,793 | 9/1995 | Dobson et al. | 101/287 |
| 5,503,070 | 4/1996 | Cheever et al. | 101/291 |

*Primary Examiner*—Ren Yan
*Assistant Examiner*—Dave A. Ghatt

[57] ABSTRACT

A coding and marking printer system having an unwind reel coupled to a rotatable drag pulley to supply ribbon from a depletable ribbon supply roll disposed thereon to a first guide roller, to a dancer guide roller on a pivotal dancer arm, and then to a rewind reel. A drag belt disposed partially about the drag pulley has first and second ends coupled to the dancer arm, which is pivotal about its axis to control tension on the drag belt as ribbon is supplied from the unwind reel, whereby drag on the unwind reel increases as the ribbon supply roll decreases in size to maintain relatively constant drag on the ribbon. A heated rotatable typeholder is actuatably disposed in an insulated heater block to reduce heat radiation therefrom, particularly when the heater block is oriented with the typeholder directed upwardly. The printer system includes a cassette assembly removably mountable onto a main plate assembly having an alignment member disposeable in an aperture of the cassette assembly for accurate alignment and spacing therebetween. A latch assembly lockingly retains the cassette assembly on the main plate assembly.

23 Claims, 2 Drawing Sheets

MODULAR PRINTER SYSTEM WITH DEPLETING RIBBON SUPPLY ROLL AND HEATED TYPEHOLDER

BACKGROUND OF THE INVENTION

The invention relates generally to printing systems, and more particularly to modular printer systems having a depleting ribbon supply roll and a heated print-head for transferring ink from the ribbon onto a substrate, which may be moving continuously, particularly in coding and marking operations.

In the manufacturing and packaging of many products it is often desirable to print variable information on the product directly or on its packaging in marking and coding operations. The food, beverage and pharmaceutical industries, for example, frequently print lot numbers, expiration dates, production codes, pricing and other variable information on articles, and labels and packaging therefor, all of which are referred to herein generally as substrate.

One particular type of printer system suitable for marking and coding operations includes generally an inked print ribbon transferred from a ribbon supply roll disposed on an unwind reel, to a print position adjacent a print-head, or typeholder, and then to a rewind reel, about which ink depleted ribbon is wound. The ribbon is advanced intermittently between the typeholder and the substrate, usually during or between printing operations, wherein the typeholder is selectively actuatable, either rotationally or linearly, to transfer ink from the ribbon onto a target area of the substrate at the print position, thereby printing or imprinting information thereon.

In the past, many coding and marking printer systems were operated pneumatically, including among other operational aspects of the systems actuation of the typeholder and advancement of the ribbon. More recently, however, there has been a trend in the manufacturing and packaging industries to eliminate from their facilities compressed air supply systems, which increase infrastructure, operational and maintenance costs. Also, usage of compressed air is very often a source of product contamination, particularly in the food processing and packaging industries. Pneumatically operated coding and marking systems arc thus being replaced increasingly with electrically operated systems, which are less costly and less problematic.

One problem associated with coding and marking systems that supply ribbon from a ribbon supply roll is a tendency toward decreasing drag on the ribbon as the ribbon supply roll is depleted, which results generally from the decreasing mass and diameter, or size, thereof. This is true more generally of any system that supplies a continuous web from a depleting web supply roll. It is generally desirable however to maintain relatively constant drag on the ribbon or web to provide improved control over the supplying thereof. It is especially desirable to maintain relatively constant drag on ribbon supplied in coding and marking systems that advance ribbon intermittently with an electric motor having a fixed driving torque as disclosed in the present invention.

Many coding and marking systems also include a heated typeholder for transferring ink from the print ribbon onto the substrate. One such typeholder, for example, is a rotatable typeholder configurable with variable type nearly completely disposed in a radiant oven, or heater block, except for a portion thereof, which is protrudable from an opening of the heater block during printing operations. A problem common to heater blocks, and more particularly to heated typeholders, is a tendency to radiate away heat, thereby reducing the efficacy of ink transfer from the ribbon onto the substrate and increasing operating costs. It is thus desirable to reduce radiant heat loss from the typeholder, particularly in applications where the orientation of the heater block promotes radiant heat loss. In vertical form, fill and seal packaging operations, for example, product is gravity fed vertically into a partially formed package, which is supplied from a generally horizontal continuous substrate where the coding and marking operations are performed before the forming and filling operations. Coding and marking systems for printing on horizontally moving substrates though are nearly always oriented below the substrate so that the opening of the heater block and typeholder face upwardly, whereby heat radiation away therefrom is substantial.

Since most coding and marking systems are operated and serviced by personnel not knowledgeable with the intricacies thereof, the systems must be relatively simple and highly reliable. It is often desirable therefore to mount the ribbon unwind and rewind reels on a cassette assembly that is readily removably mountable onto a main plate assembly, thereby facilitating replacement of ink depleted print ribbon supply rolls and providing access to the interior thereof for maintenance. Removable cassette assemblies are known generally, but it is desirable to provide an improved cassette assembly that is more readily and accurately alignable and spaced relative to the main plate assembly. It is also desirable to provide a cassette assembly that is positively lockingly engageable to the main plate assembly economically and reliably.

The present invention is therefore drawn generally toward novel advancements in the art of printing systems, and more particularly to improvements applicable to printer systems having a depleting ribbon supply roll and a heated typeholder useable for coding and marking operations on continuously moving substrates.

It is an object of the invention to provide novel printing systems, especially coding and marking printer systems, that overcome problems in the prior art by improving various aspects of prior art printing systems including improved ribbon drag control, improved heater block insulation, improved system modularity, and combinations thereof, all of which have improved economics and reliability.

It is a more particular object of the invention to provide novel printer systems, particularly coding and marking printer systems, comprising an unwind reel coupled to a rotatable drag pulley to supply ribbon from a depletable ribbon supply roll disposed thereon to a typeholder and then to a rewind reel, which winds ink deplete ribbon thereabout. The ribbon is supplied generally from the unwind reel to a first guide roller, to a dancer guide roller on a pivotal dancer arm, and then to the rewind reel. A drag belt disposed partially about the drag pulley has a first end coupled to the dancer arm on a first side of its pivot axis and a second end coupled to the dancer arm on a second side of the pivot axis. The dancer arm is pivotal about its axis to control tension on the drag belt as ribbon is supplied from the unwind reel, whereby drag on the unwind reel increases generally as the ribbon supply roll decreases in size to maintain relatively constant drag thereon.

It is another more particular object of the invention to provide novel printer systems of the type discussed generally above also comprising an electrically driven feed roller frictionally engageable with the ribbon to unwind ribbon from the unwind reel, and related thereto the feed roller may be rotatably coupled to the rewind reel about which ink deplete ribbon is wound, whereby an electric drive motor rotates both the rewind reel and the feed roller.

It is also an object of the invention to provide novel printer systems, particularly coding and marking printer systems, comprising a heated typeholder, which may be rotatable, actuatably disposed in an at least partially insulated heater block having one or more insulator members disposed adjacent one or more corresponding surfaces thereof, preferably adjacent upwardly directed surfaces thereof, whereby the insulator members reduce heat radiation from the heater block and the typeholder. It is a related object of the invention to provide one or more insulator members disposed adjacent corresponding surfaces adjacent an opening of the heater block, through which the typeholder is protrudable during printing operations, thereby reducing heat radiation therefrom, particularly when the heater block is oriented with its opening and the typeholder directed upwardly.

It is a further object of the invention to provide novel modular printer systems, particularly modular coding and marking printer systems, comprising a main plate assembly wherein an unwind reel, a dancer arm and a rewind reel are mounted on a cassette assembly removably and lockingly mountable to the main plate assembly. It is a related object of the invention to provide a main plate assembly having one or more alignment members protruding therefrom, and the cassette assembly having apertures for receiving corresponding alignment members of the main plate assembly when the cassette assembly is mounted thereto, wherein the alignment members are disposeable in the apertures of the cassette assembly to align and or space the cassette assembly relative to the main plate assembly. It is yet another related object of the invention to provide a sliding block having an end portion biased over a portion of an aperture of the cassette assembly for receiving an alignment member of the main plate assembly having a recess, whereby an end portion of the sliding block is engageable with the recess of the alignment member to lockingly retain the cassette assembly mounted to the main plate assembly.

These and other objects, features, aspects and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 2:
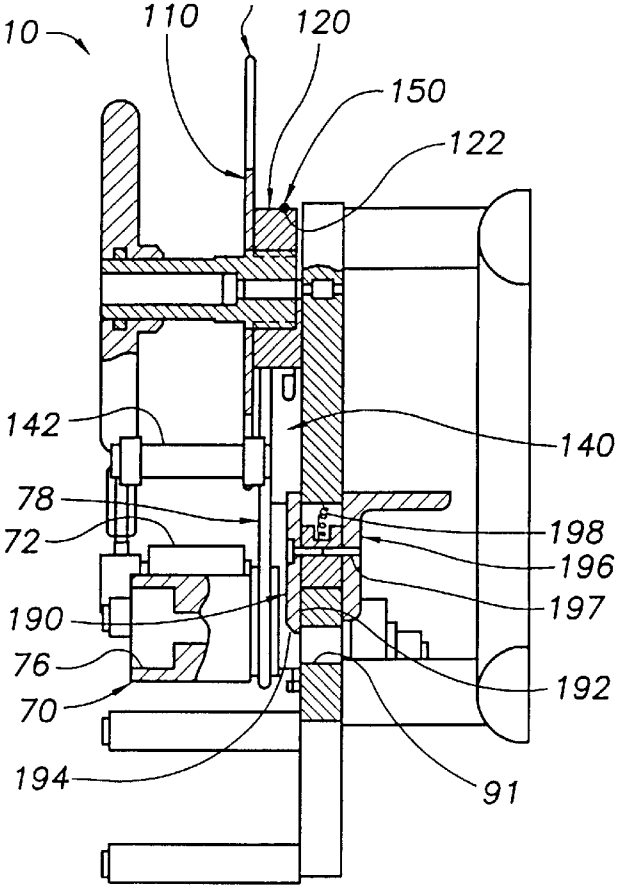
FIG. 2 is a partial sectional end view along lines a—a of FIG. 1.
Figure 1:
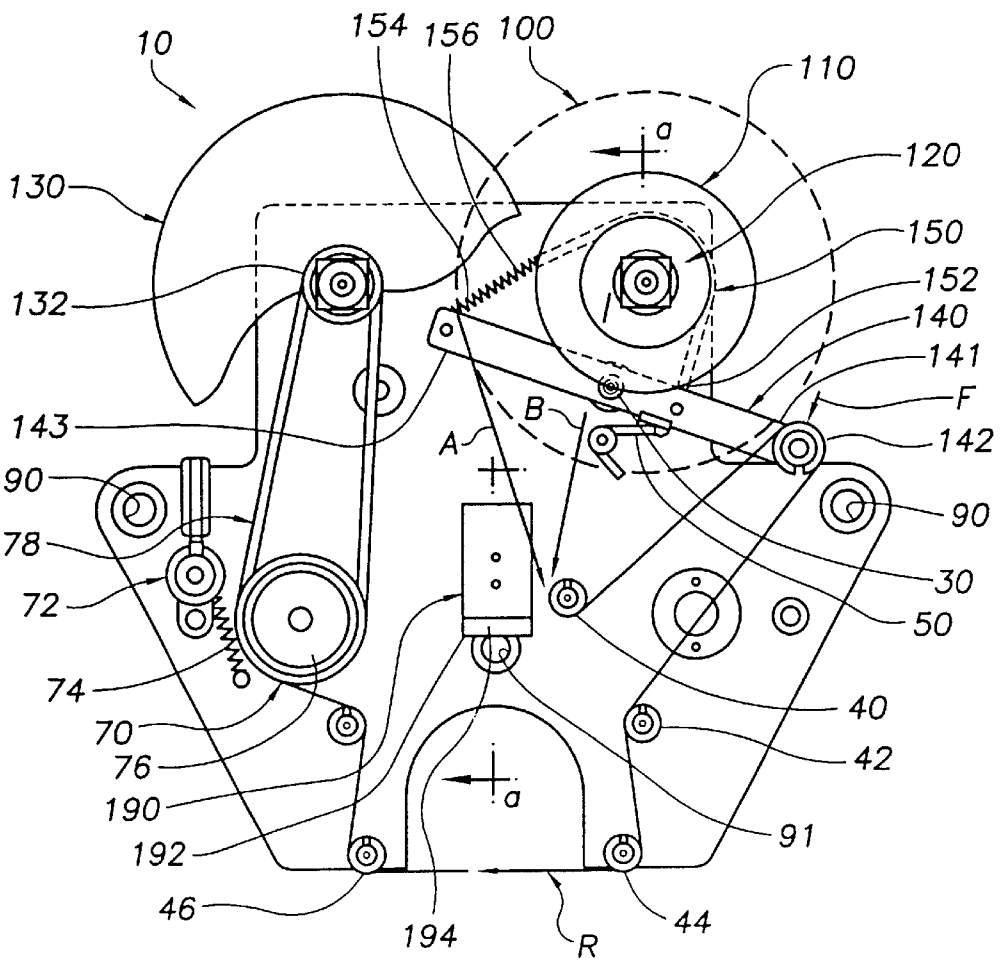
FIG. 1 is back side elevational view of a modular printer system cassette assembly including an unwind reel with a ribbon supply roll disposed thereon, a dancer arm, and a ribbon rewind reel.
Figure 4:
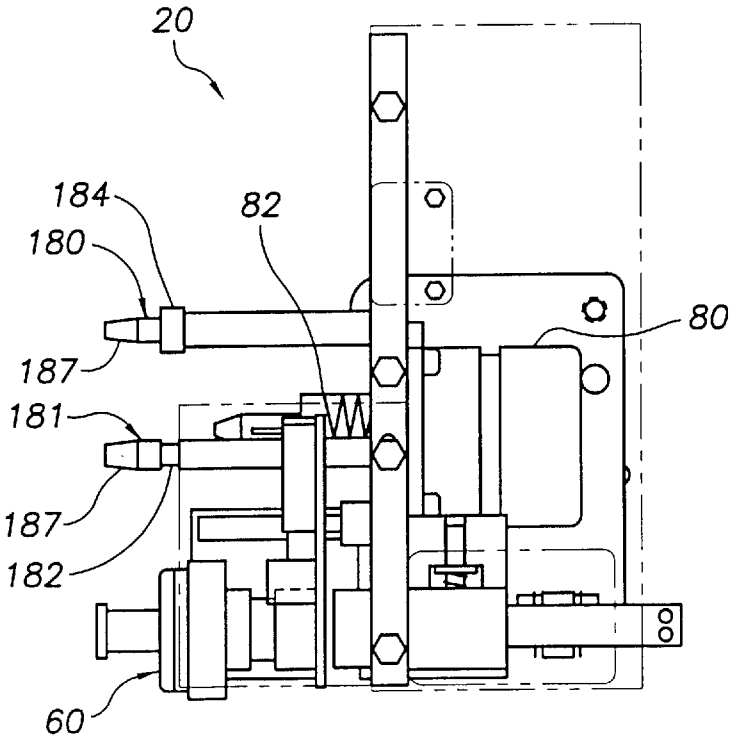
FIG. 4 is an end view of FIG. 3.
Figure 3:
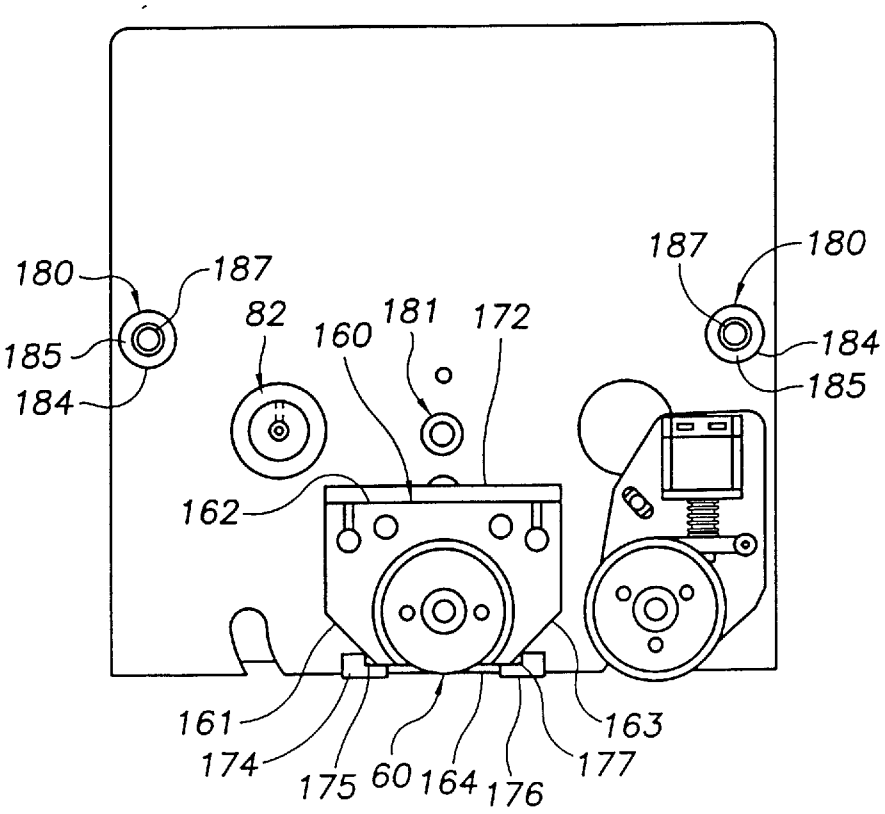
FIG. 3 is front side elevational view of a modular printer system main plate assembly including a heated type holder and a plurality of alignment rods for supportably mounting a cassette assembly thereon.

FIGS. 1 and 2 illustrate a cassette assembly 10 supportably and removably mountable on a main plate assembly 20 illustrated in FIGS. 3 and 4 to form a modular printer system useable for transferring ink from a print ribbon R onto a substrate, particularly in coding and marking operations. Many aspects of the present invention, however, are applicable more generally to other printing systems, including non-modular printing systems of the type not having a removable cassette assembly.

FIG. 1 illustrates in phantom a ribbon supply roll 100 having inked ribbon wound about an inner core member, which is usually cardboard, disposed and frictionally retained on an unwind reel 110 coupled to a drag pulley 120, wherein the unwind reel 110 and the drag pulley 120 are rotatable together to supply ribbon therefrom. The ribbon is drawn from the unwind reel 110 generally under tension and is supplied to a rewind reel 130, which winds ink depleted ribbon thereabout, wherein the ribbon supply roll 100 decreases in size as ribbon is supplied therefrom, as discussed further below.

FIGS. 1 and 2 illustrate a dancer arm 140 disposed pivotally about a pivot member 30 located, or disposed, intermediate a first guide roller 40 and the unwind reel 110. The dancer arm 140 includes a first end portion 141 on a first side of the pivot member 30 with a dancer guide roller 142 disposed thereon. FIG. 1 illustrates ribbon R supplied from the supply roll 100 on the unwind reel 110 to the first guide roller 40 located on the second side opposite the first side of the pivot member 30, from the first guide roller 40 to the dancer guide roller 142, and then to the rewind reel 130. The print ribbon R is fed past the typeholder 60, shown in FIGS. 3 and 4, when the cassette assembly 10 is mounted on the main plate assembly 20.

The dancer arm 140 is pivotal in a first direction F, clockwise in FIG. 1, against the bias of a dancer spring member 50 coupled thereto in response to increasing tension applied to the ribbon. The dancer spring 50 pivotally biases the dancer guide roller 142 in a second direction, counterclockwise in FIG. 1. The dancer arm 140 thus pivots in response to changes in ribbon tension, particularly relatively instantaneous changes in ribbon tension, to regulate or maintain relatively constant tension thereon.

FIGS. 1 and 2 illustrate a drag belt 150 disposed partially about the drag pulley 120 in a groove 122 thereof opposite the pivot member 30, wherein a first end 152 of the drag belt 150 is coupled to the first side 141 of the dancer arm 140 and a second end 154 of the drag belt 150 is coupled to a second side 143 of the dancer arm 140 on the second side of the pivot member 30. The drag belt 150 generally provides drag on the unwind reel 110 dependent on the pivotal position of the dancer arm 140. The dancer arm 140 is thus pivotal in the first and second opposing directions about the pivot member 30 to control tension on the drag belt 150 as ribbon is supplied from the unwind reel 110, whereby drag on the unwind reel 100 generally increases as the ribbon supply roll decreases in size to maintain relatively constant drag on the ribbon.

FIG. 1 illustrates ribbon portions A and B directed tangentially from the ribbon supply roll 100 and toward the first guide roller 40 corresponding to maximum and minimum diameters of the ribbon supply roll 100, respectively. As the size of the ribbon supply roll 100 decreases, the dancer arm 140 pivots generally increasingly in the first direction F against the bias of the dancer spring member 50. The dancer arm 140 however will continue to pivot in both the first and second directions responsive to changes in ribbon tension, but the pivoting action will be relative to a steady state position of the dancer arm corresponding to constant ribbon tension, wherein the steady state position of the dancer arm 140 is dependant also on ribbon supply roll size and moves increasingly in the first direction F as the ribbon supply roll size decreases thereby increasing tension on the drag belt 150, which increases drag on the unwind reel 110.

In operation, the first end portion 141 of the dancer arm 140 pivots in the first direction F to increase tension on the drag belt 150, and more particularly to urge the drag belt 150 into increasingly binding frictional engagement with the drag pulley 120, which increases drag on the unwind reel 110 and hence on the ribbon supplied therefrom. The increased drag on the unwind reel 110 imposed by tension in the drag belt 150 compensates for a general reduction in drag on the rewind reel resulting from decreasing inertia of the ribbon supply roll 100 as its size decreases. The overall effect of the drag belt 150 is thus to maintain relatively constant drag on ribbon supplied from the ribbon supply roll 100 as its size decreases.

According to a related aspect of the invention, the drag belt 150 includes a longitudinally elastic portion 156 that stretches as the dancer arm 140 pivots in the first direction F, and recoils as the dancer arm 140 pivots in the second direction opposite F. Thus the longitudinally elastic portion 156 of the drag belt 150 tends to moderate changes in drag belt tension and thus drag applied to the drag pulley 120 as the dancer arm 140 pivots about the pivoting member 30. The longitudinally elastic portion 156 may be a discrete coil spring member, or alternatively the drag belt 150 may be an elastomeric material, or a combination thereof.

FIG. 1 illustrates the dancer guide roller 142 disposed intermediate the first guide roller 40 and a second guide roller 42, wherein the ribbon is supplied from the dancer guide roller 142 to the second guide roller 42 and then to the rewind reel 130. The cassette assembly 10 includes further a third guide roller 44 and a fourth guide roller 46 disposeable on opposing sides of a typeholder 60, which in the exemplary embodiment is disposed on the main plate assembly 20 as illustrated in FIGS. 3 and 4 and discussed further below. The ribbon is thus supplied from the second guide roller 42 to the third guide 44 roller, then to the fourth guide roller 46, and then to the unwind reel 110, whereby the third and fourth guide rollers 44 and 46 support the ribbon adjacent the typeholder 60 when the cassette assembly 10 is mounted on the main plate assembly 20. In the exemplary modular printer system disclosed, the unwind reel 110, the dancer arm 140, the rewind reel 130, and the guide rollers are mounted on the cassette assembly 10.

FIGS. 1 and 2 illustrate an electrically driven feed roller 70 frictionally engageable with the ribbon to apply tension thereto thereby unwinding the ribbon from the unwind reel 110. The feed roller 70 is rotatably coupled to a one-way clutch, for example a Torrington clutch, which permits rotation thereof in only the direction of ribbon advancement. A pressure roller 72 is pivotally biasable toward the feed roller 70 by a spring member 74 to frictionally engage the ribbon therebetween, and the pressure roller 72 is pivotal against the bias of the spring member 74 to frictionally disengage the ribbon, which latter configuration is shown in FIG. 1.

FIGS. 3 and 4 illustrate the feed roller 70 driven by an electric drive motor 80 having a flexible coupling 82 both mounted on the main plate assembly 20. The flexible coupling 82 is rotatably coupleable to the feed roller 70 illustrated in FIGS. 1 and 2, and more particularly disposeable in and frictionally engageable with a recess 76 thereof when the cassette assembly 10 is mounted on the main plate assembly 20. According to one mode of operating the printer system of the exemplary embodiment, the ribbon is selectively intermittently advanced relative to the typeholder 60 by the electrically driven feed roller 70, which rotates clockwise as viewed in FIG. 1.

FIGS. 1 and 2 illustrate the feed roller 70 coupled by a drive belt 78 to the rewind reel 130, and more particularly to a drive pulley 132 thereof, whereby the electric drive motor 80, illustrated in FIG. 4, rotates the feed roller 70 and the rewind reel 130 in the clockwise direction. The tension on and advancement of the ribbon supplied from the unwind reel 110 however results generally from frictional engagement of the ribbon between the feed roller 70 and the pressure roller 72, rather than from tension applied by the rewind reel 130. In an alternative embodiment, the drive belt 78 is configured as an eight, not shown, thereby rotatably driving the feed roller 70 clockwise and rotating the rewind reel 130 counter-clockwise thus winding ink depleted ribbon counter-clockwise thereabout.

According to another aspect of the invention, FIGS. 3 and 4 illustrate the typeholder, and more particularly a rotatable typeholder 60, actuatably disposed in a heater block 160, and preferably intermittently rotatable with the intermittently advanced ribbon for selectively printing or imprinting onto a continuously moving substrate. The heater block 160 includes generally one or more insulator members disposed adjacent one or more corresponding surface portions thereof, and preferably adjacent one or more upwardly directed surface portions thereof, whereby the insulator members reduce radiation of heat away from the heater block 160 and the typeholder.

In FIGS. 3 and 4, more particularly, a portion of the heater block 160 includes an opening 164 to permit exposure of a protruding portion of the intermittently rotatable typeholder 60 during printing operations. The heater block 160 includes also first and second surface portions 161 and 163 adjacent the opening 164 thereof, which first and second surface portions 161 and 163 may taper narrowingly toward the opening 164. A first insulator portion 174 is disposed adjacent the first surface portion 161 of the heater block and preferably forms a first air gap 175 therebetween, and a second insulator portion 176 is disposed adjacent the second surface portion 163 of the heater block and preferably forms a second air gap 177 therebetween, thereby providing excellent thermal insulation for the heater block and the typeholder. The insulating portions 174 and 176 permit orientation of the printer system below a substantially horizontally moving substrate, as in vertical form, fill and seal packaging operations, so that the opening 164 of the heater block 160 and typeholder 60 may face upwardly with substantially reduced heat radiation therefrom. A third insulator portion 172 is disposed adjacent a third surface portion 162 of the heater block 160, which is substantially opposite the opening 164 thereof, and reduces heat radiation from the heater block 160, particularly when the opening 164 thereof and typeholder 60 are directed downwardly.

According to another aspect of the invention, FIGS. 3 and 4 illustrate the main plate assembly 20 having one or more alignment members protruding therefrom and disposeable in corresponding apertures of the cassette assembly 10 for alignment thereof when mounted together. In the exemplary embodiment, the alignment members include preferably two outer alignment rods 180 and a central alignment rod 181. FIG. 1 illustrates the cassette assembly 10 having corresponding outer apertures 90 and a central aperture 91 in alignment with the alignment rods 180 and 181 protruding from the main plate assembly 20. The alignment rods 180 and 181 are thus disposeable in corresponding apertures 90 and 91 of the cassette assembly 10 to align the cassette assembly 10 with the main plate assembly 20, and more particularly to align the ribbon relative to the typeholder 60 and to align the feed roller 70 relative to the flexible coupling 82, including alignment of other components cooperating therebetween, whereby the cassette assembly 10 is supportably and removably mountable on the main plate assembly 20.

FIG. 4 illustrates a recess 182 disposed about one of the alignment members, specifically the centrally located alignment rod 181, but the recess 182 may be disposed more generally about any one of the alignment rods 180. FIGS. 1 and 2 illustrate a sliding block 190 slidably disposed along an inner surface of the cassette assembly 10 and having an end portion 192 biased over at least a portion of the central aperture 91 thereof for receiving the central alignment rod 181 having the recess 182. The end portion 192 of the sliding block 190 includes a bevelled surface 194 engageable with the central alignment rod 181 to slide the sliding block 190 away from the central aperture 91 of the cassette assembly 10 as the central alignment rod 181 is disposed in the central aperture 91, whereby the end portion 192 of the sliding block 190 is engageable with the recess 182 of the central alignment rod 181 to lockingly retain the cassette assembly 10 mounted on the main plate assembly 20.

FIG. 2 illustrates a lever 196 also slidably disposed along an outer side of the cassette assembly 10 substantially opposite the sliding block 190 and coupled thereto by one or more fasteners, or pins, 197 to form an actuatable latch assembly. A compression spring 198 acting on the latch assembly biases the end portion 192 of the sliding block 190 over the central aperture 91 of the cassette assembly 10, whereby the end portion 192 is slidable away from the central aperture 91 against the bias of the spring member 198 to disengage the sliding block 190 from the recess 182 of the central alignment rod 181 thereby unlocking the cassette assembly 10 from the main plate assembly 20 whereupon the cassette assembly may be removed therefrom.

FIGS. 3 and 4 also illustrate the outer alignment rods 180 each having a collar member 184 disposed about an end portion thereof, wherein the collars 184 have an outer end surface 185 engageable with the cassette assembly 10 to properly and accurately space the cassette assembly 10 from the main plate assembly 20. Also, one or more of the plurality of guide rollers 40, 42, 44, and 46, but not the dancer guide roller 142, of the cassette assembly 10 may abut the main plate assembly 20 when the cassette assembly 10 is mounted thereon, thereby providing further support and spacing therebetween. The alignment rods 180 and 181 of the main plate assembly have preferably a tapered end portion 187 to facilitate insertion thereof into the corresponding apertures 90 and 91 of the cassette assembly 10.

While the foregoing written description of the invention enables one of ordinary skill in the art to make and use what is at present considered to be the best mode of the invention, it will be appreciated and understood by those of ordinary skill the existence of variations, combinations, modifications and equivalents within the spirit and scope of the specific exemplary embodiments disclosed herein. The present invention is therefore to be limited not by the specific exemplary embodiments disclosed herein but by all embodiments within the scope of the appended claims.

What is claimed is:

1. A printer system useable for transferring print from a ribbon onto a substrate, the printer system comprising:

an unwind reel coupled to a drag pulley, the unwind reel and the drag pulley rotatable to supply ribbon from a depletable ribbon supply roll disposed on the unwind reel;

a first guide roller;

a dancer arm pivotal about a pivot member, the dancer arm having a first end portion with a dancer guide roller on a first side of the pivot member, the pivot member disposed intermediate the first guide roller and the unwind reel;

a drag belt disposed partially about the drag pulley opposite the pivot member, the drag belt having a first end coupled to the dancer arm on the first side of the pivot member, and the drag belt having a second end coupled to the dancer arm on a second side of the pivot member opposite the first side of the pivot member;

the ribbon supplied from the unwind reel to the first guide roller on the second side of the pivot member, and from the first guide roller to the dancer guide roller, the dancer arm pivotal in first and second opposing directions about the pivot member to control tension on the drag belt as ribbon is supplied from the unwind reel, whereby drag on the unwind reel increases as the ribbon supply roll size decreases.

2. The printer system of claim 1 further comprising a dancer spring member coupled to the dancer arm, the dancer spring member pivotally biasing the dancer arm in the second direction, whereby the dancer arm tends to pivot in the first direction as the ribbon supply roll size decreases.

3. The printer system of claim 2, the drag belt including a longitudinally elastic portion stretchable as the dancer arm pivots in the first direction.

4. The printer system of claim 1 further comprising a rewind reel for winding ribbon supplied from the unwind reel, whereby the ribbon is supplied from the dancer guide roller to the rewind reel.

5. The printer system of claim 4 further comprising a second guide roller, the dancer guide roller disposed intermediate the first and second guide rollers, the ribbon supplied from the dancer guide roller to the second guide roller and then to the rewind reel.

6. The printer system of claim 5 further comprising a typeholder, a third guide roller on one side of the typeholder and a fourth guide roller on an opposing side of the typeholder, the ribbon supplied from the second guide roller to the third guide roller and then to the fourth guide roller, and then to the unwind reel, whereby the third and fourth guide rollers support the ribbon adjacent the typeholder.

7. The printer system of claim 1 further comprising an electrically driven feed roller frictionally engageable with the ribbon to unwind ribbon from the unwind reel.

8. The printer system of claim 7 further comprising a pressure roller biasable toward the feed roller to frictionally engage the ribbon between the feed roller and the pressure roller, and an electric drive motor rotatably coupled to the feed roller and the rewind reel, whereby the electric drive motor rotates the rewind reel and the feed roller.

9. The printer system of claim 1 further comprising a heated typeholder actuatably disposed in a heater block having an insulator member disposed on at least one of an tipper portion of the heater block and a lower portion of the heater block, whereby the insulator member reduces radiation of heat from the heater block and the typeholder.

10. A printer system having a heated typeholder for transferring print from a ribbon onto a substrate, the printer system comprising:

an unwind reel supplying ribbon from a depletable ribbon supply roll disposed on the unwind reel to a rewind reel, a first guide roller;

a dancer arm pivotal about a pivot member, the dancer arm having a first end portion with a dancer guide roller on a first side of the pivot member, the pivot member disposed intermediate the first guide roller and the unwind reel, the ribbon is supplied from the unwind reel to the first guide roller on the second side of the pivot member, to the dancer guide roller, past the typeholder, and to the rewind reel;

a heater block for receiving the typeholder, a portion of the heater block having an opening to expose at least a portion of the typeholder at least during printing operations;

an insulator member disposed adjacent at least one surface portion of the heater block, whereby the insulator member reduces heat radiated away from the typeholder.

11. The printer system of claim 10, the heater block having first and second surface portions adjacent the opening of the heater block, a first insulator portion disposed adjacent the first surface portion of the heater block, and a second insulator portion disposed adjacent the second surface portion of the heater block, whereby the first and second insulator portions reduce heat radiated away from the first and second surface portions adjacent the opening of the heater block.

12. The printer system of claim 11 further comprising a first air gap between the first insulator portion and the first surface portion of the heater block, and a second air gap between the second insulator portion and the second surface portion of the heater block.

13. The printer system of claim 11 further comprising a third insulator portion disposed adjacent a third surface portion of the heater block substantially opposite the opening of the heater block.

14. The printer system of claim 10 wherein the at least one surface portion of the heater block is an upwardly directed surface portion, and the insulator member disposed adjacent the upwardly directed surface portion of the heater block.

15. The printer system of claim 10, the typeholder is a rotatable typeholder intermittently actuatable for imprinting onto a continuously moving substrate.

16. The printer system of claim 10 further comprising:

a drag pulley coupled to and rotatable with the unwind reel;

a drag belt disposed partially about the drag pulley opposite the pivot member, the drag belt having a first end coupled to the dancer arm on the first side of the pivot member, and the drag belt having a second end coupled to the dancer arm on a second side of the pivot member opposite the first side of the pivot member;

the dancer arm pivotal in first and second opposing directions about the pivot member to control tension on the drag belt as ribbon is supplied from the unwind reel, whereby drag on the unwind reel increases as the ribbon supply roll size decreases.

17. A printer system useable for printing on a substrate, the printer system comprising:

a main plate assembly having a protruding alignment member;

a cassette having an unwind reel supplying ribbon from a depletable ribbon supply roll disposed on the unwind reel to a rewind reel, the cassette assembly having an aperture corresponding to the alignment member protruding from the main plate assembly, the alignment member disposeable in the aperture of the cassette assembly to align the cassette assembly with the main plate assembly, the cassette assembly is removably mountable on the main plate assembly, a recess disposed in the alignment member of the main plate assembly;

a sliding block having an end portion biased over a portion of an aperture of the cassette assembly for receiving the alignment member having the recess, the end portion of the sliding block engageable with the alignment member having the recess to slide the sliding block away from the aperture of the cassette assembly as the alignment member is disposed in the aperture of the cassette assembly, whereby the end portion of the sliding block is engageable with the recess of the alignment member to lockingly retain the cassette assembly to the main plate assembly.

18. The printer system of claim 17, the end portion of the sliding block having a bevelled surface engageable with the alignment member having the recess to slide the sliding block away from the aperture of the cassette assembly as the alignment member is disposed in the aperture of the cassette assembly.

19. The printer system of claim 17 further comprising a lever disposed along an outer side of the cassette assembly, the lever coupled to the sliding block disposed on an opposing side of the cassette assembly to form a latch assembly, a compression spring acting on the latch assembly to bias the end portion of the sliding block over the aperture of the cassette assembly, whereby the end portion of the sliding block is slidable away from the aperture of the cassette assembly to disengage the recess of the alignment member and release the cassette assembly from the main plate assembly.

20. The printer system of claim 17, the alignment member is a plurality of at least two alignment rods protruding from the main plate assembly, the cassette assembly having a corresponding number of apertures for receiving the plurality of alignment rods, and a recess disposed about one of the alignment rods.

21. The printer system of claim 20 further comprising a collar member disposed about an end portion of at least one of the plurality of alignment rods, the collar engageable with the cassette assembly to space the cassette assembly from the main plate assembly, and the alignment rods having a tapered end portion to facilitate insertion of the alignment rods into the apertures of the cassette assembly.

22. The printer system of claim 17, the cassette assembly including a plurality of guide rollers for guiding the ribbon from the unwind reel to the dancer guide roller, and to the rewind reel, the plurality of guide rollers abutting the main plate assembly when the cassette assembly is mounted on the main plate assembly, whereby the ribbon is positioned adjacent the typeholder of the main plate assembly for printing from the ribbon onto the substrate.

23. The printer system of claim 17 further comprising:

a dancer arm pivotal about a pivot member coupled to the cassette assembly, the dancer arm having a first end portion with a dancer guide roller on a first side of the pivot member, the pivot member disposed intermediate the first guide roller and the unwind reel, the ribbon supplied from the unwind reel to the first guide roller on the second side of the pivot member, from the first guide roller to the dancer guide roller, and to the rewind reel, a drag pulley coupled to and rotatable with the unwind reel;

a drag belt disposed partially about the drag pulley opposite the pivot member, the drag belt having a first end coupled to the dancer arm on the first side of the pivot member, and the drag belt having a second end coupled to the dancer arm on a second side of the pivot member opposite the first side of the pivot member;

the dancer arm pivotal in first and second opposing directions about the pivot member to control tension on the drag belt as ribbon is supplied from the unwind reel, whereby drag on the unwind reel increases as the ribbon supply roll size decreases.

* * * * *